US008362958B2

(12) United States Patent
Lin et al.

(10) Patent No.: US 8,362,958 B2
(45) Date of Patent: Jan. 29, 2013

(54) APERTURE ANTENNA

(75) Inventors: Shih-Kai Lin, Taipei (TW); Bing-Syun Li, Taipei (TW); Yi-Cheng Lin, Taipei (TW)

(73) Assignee: National Taiwan University, Taipei (TW)

( * ) Notice: Subject to any disclaimer, the term of this patent is extended or adjusted under 35 U.S.C. 154(b) by 758 days.

(21) Appl. No.: 12/536,322

(22) Filed: Aug. 5, 2009

(65) Prior Publication Data

US 2010/0194644 A1 Aug. 5, 2010

(30) Foreign Application Priority Data

Feb. 2, 2009 (TW) ..... 98103203 A

(51) Int. Cl.
*H01Q 1/38* (2006.01)
*H01Q 13/10* (2006.01)

(52) U.S. Cl. ..... 343/700 MS; 343/767

(58) Field of Classification Search ..... 343/700 MS, 343/767

See application file for complete search history.

(56) References Cited

U.S. PATENT DOCUMENTS 6,762,729 B2 * 7/2004 Egashira ..... 343/767
7,271,768 B2 * 9/2007 Chang et al. ..... 343/700 MS
2007/0097009 A1 * 5/2007 Torres ..... 343/795

* cited by examiner

*Primary Examiner* — Jacob Y Choi
*Assistant Examiner* — Hasan Islam

(57) ABSTRACT

An aperture antenna for transmitting a circularly polarized signal is provided. The aperture antenna includes an antenna substrate, a feed conductor and an antenna ground layer. The feed conductor is microstrip-fed or coplanar-wave-guide-fed. The antenna ground layer has an aperture, the aperture has a feed portion, a signal turning point, a first edge and a second edge, the first edge connects the feed portion to the signal turning point in a first direction, and the second edge connects the feed portion to the signal turning point in a second direction, the first direction is opposite to the second direction. When the aperture antenna transmits the circularly polarized signal, a traveling wave travels on the first edge, and at least one standing wave is formed on the second edge.

11 Claims, 8 Drawing Sheets

APERTURE ANTENNA

CROSS REFERENCE TO RELATED APPLICATIONS

This application claims priority of Taiwan Patent Application No. 098103203, filed on Feb. 2, 2009, the entirety of which is incorporated by reference herein.

BACKGROUND OF THE INVENTION

1. Field of the Invention

The present invention relates to an antenna, and in particular relates to an aperture antenna transmitting a circularly polarized signal.

2. Description of the Related Art

FIGS. 1*a* and 1*b* show a conventional antenna 1 for transmitting a circularly polarized signal. The antenna 1 comprises a substrate 10, a radiator 20 and a ground layer 30. The substrate 10 comprises a first surface and a second surface. The first surface is opposite to the second surface. The radiator 20 is disposed on the first surface. The ground layer 30 is disposed on the second surface. The radiator 20 is rectangular, and comprises a beveled corner 21. FIG. 1*b* is a sectional view along direction I-I of FIG. 1, wherein a signal line 41 is electrically connected to the radiator 20 passing through the substrate 10.

A conventional antenna provides an axial ratio bandwidth of about 3~5%, which does not satisfy wideband circularly polarized signal transmission.

BRIEF SUMMARY OF THE INVENTION

A detailed description is given in the following embodiments with reference to the accompanying drawings.

An aperture antenna for transmitting a circularly polarized signal is provided. The aperture antenna includes an antenna substrate, a feed conductor and an antenna ground layer. The antenna substrate has a first surface and a second surface. The feed conductor is disposed on the first surface. The antenna ground layer is disposed on the second surface, wherein the antenna ground layer has an aperture, the aperture has a feed portion, a signal turning point, a first edge and a second edge, the first edge connects the feed portion to the signal turning point in a first direction, and the second edge connects the feed portion to the signal turning point in a second direction, the first direction is opposite to the second direction, and when the aperture antenna transmits the circularly polarized signal, a traveling wave travels on the first edge, and at least one standing wave is formed on the second edge.

The aperture antennas of the embodiments provide improved axial ratio bandwidth, which can transmit a wideband circularly polarized signal.

BRIEF DESCRIPTION OF THE DRAWINGS

The present invention can be more fully understood by reading the subsequent detailed description and examples with references made to the accompanying drawings, wherein.

DETAILED DESCRIPTION OF THE INVENTION

The following description is of the best-contemplated mode of carrying out the invention. This description is made for the purpose of illustrating the general principles of the invention and should not be taken in a limiting sense. The scope of the invention is best determined by reference to the appended claims.

Figure 1A:
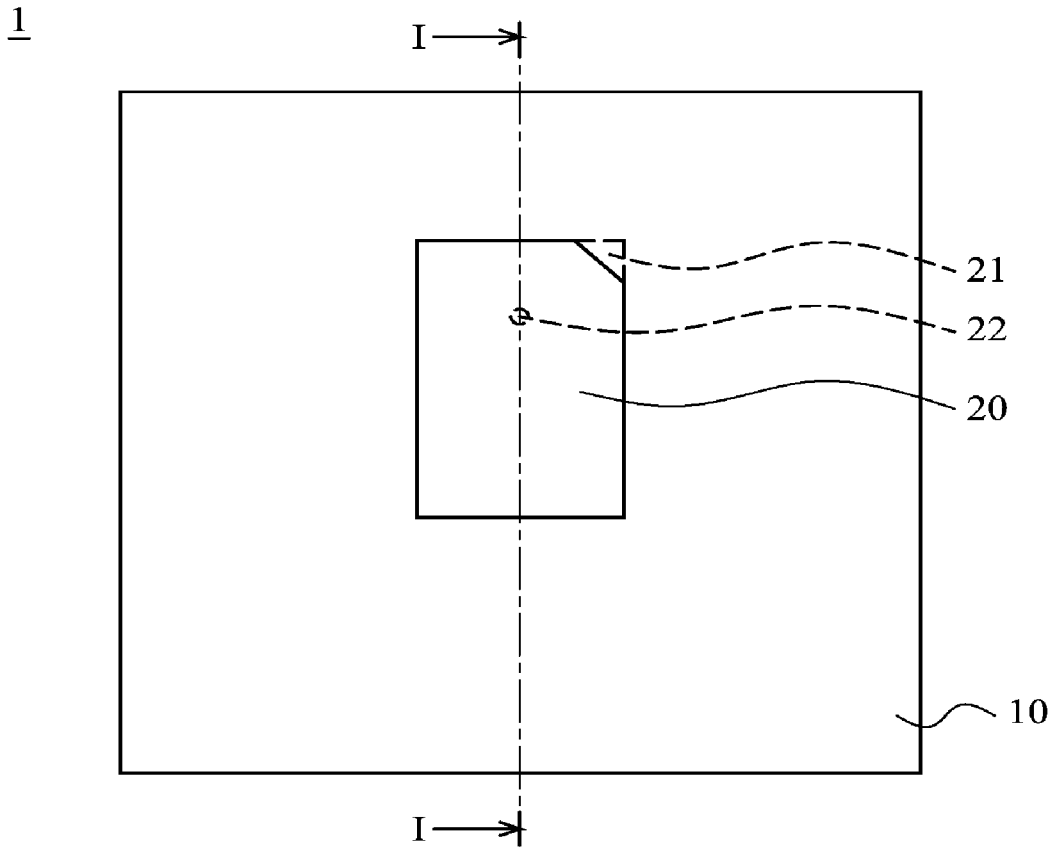
FIG. 1a ( PRIOR ART )
FIG. 1*a* shows a conventional antenna for transmitting a circularly polarized signal.
Figure 1B:
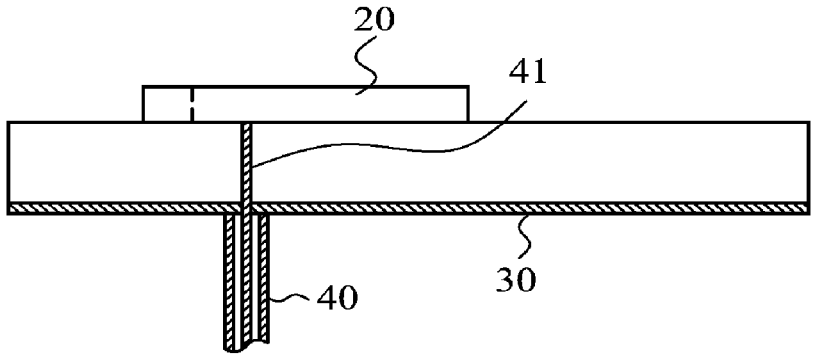
FIG. 1b ( PRIOR ART )
FIG. 1*b* is a sectional view along direction I-I of FIG. 1.
Figure 2:
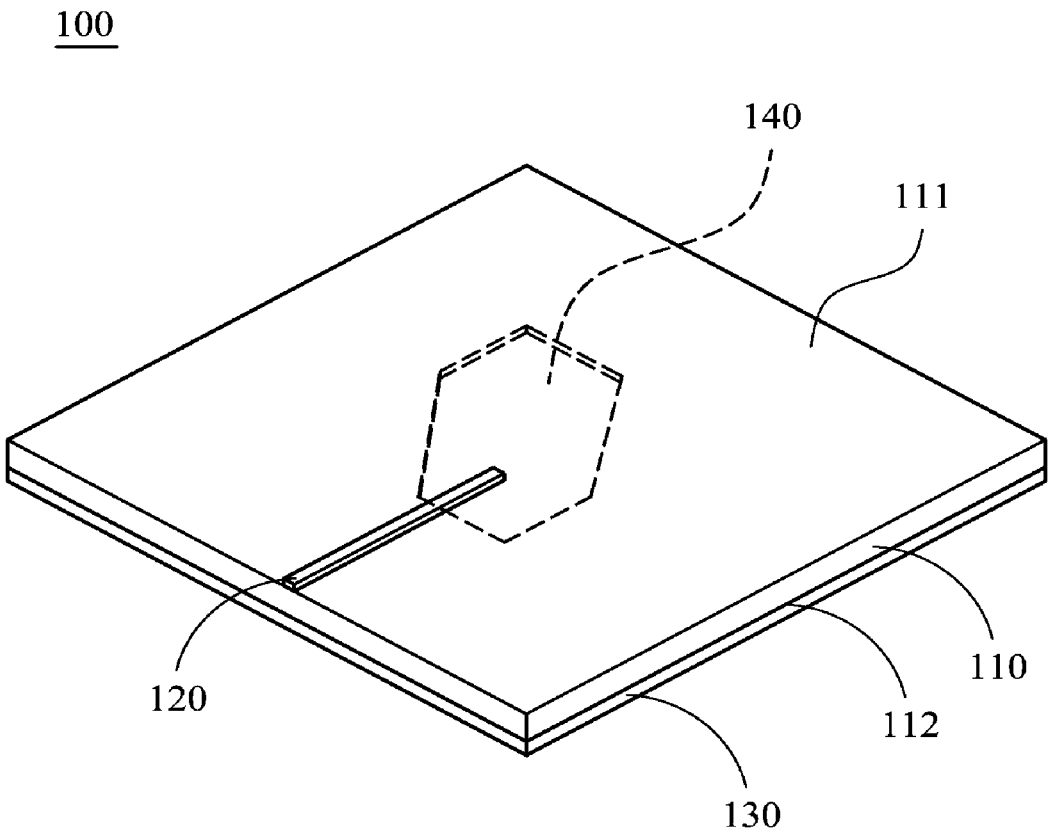
FIG. 2 shows an aperture antenna of a first embodiment of the invention.

FIG. 2 shows an aperture antenna 100 of a first embodiment of the invention for transmitting a circularly polarized signal. The aperture antenna 100 comprises an antenna substrate 110, a feed conductor 120 and an antenna ground layer 130. The antenna substrate 110 comprises a first surface 111 and a second surface 112. The feed conductor 120 is disposed on the first surface 111 as a microstrip-fed. The antenna ground layer 130 is disposed on the second surface 112. The antenna ground layer 130 has an aperture of 140.

Figure 3A:
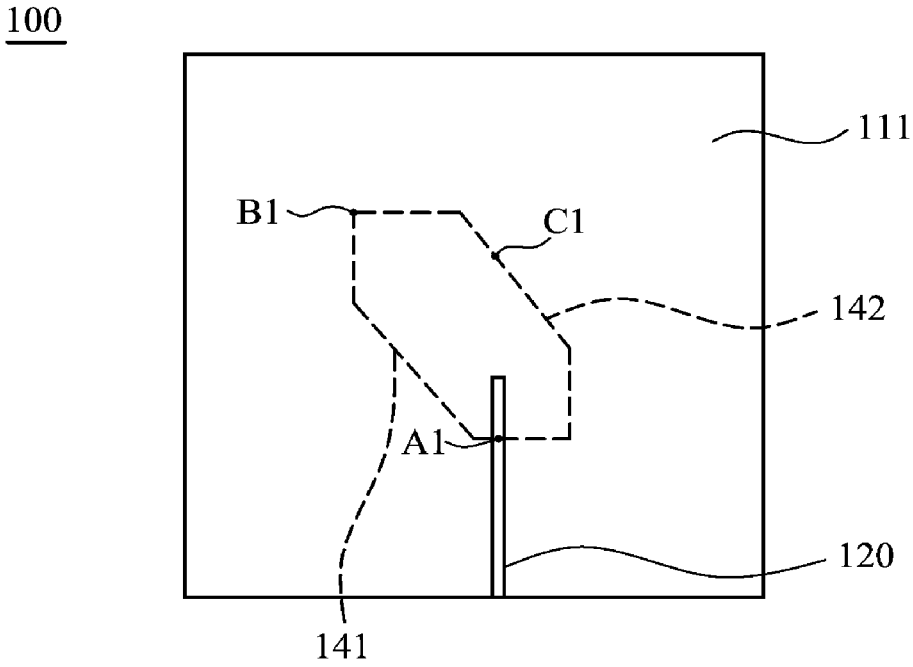
FIG. 3*a* is a top view of the aperture antenna of the first embodiment.
Figure 3B:
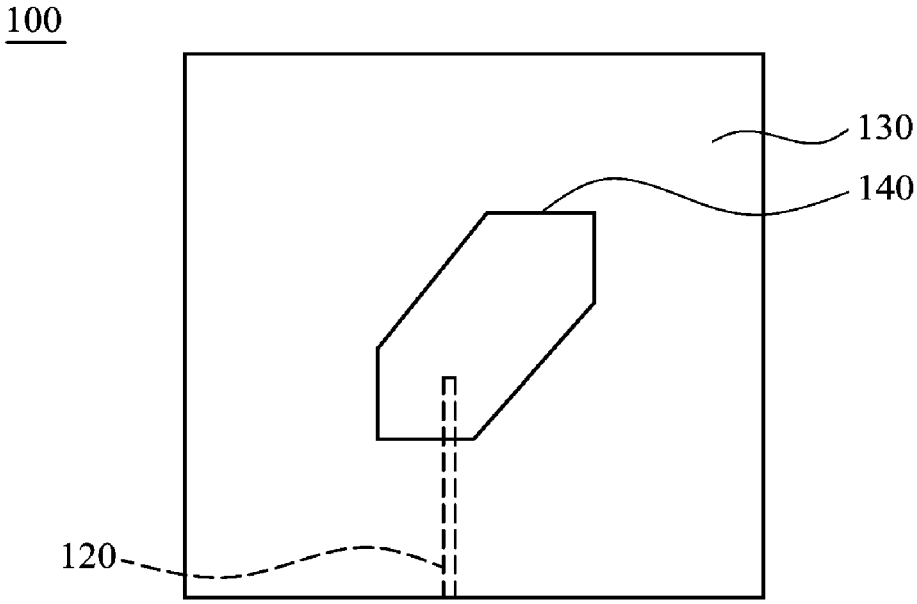
FIG. 3*b* is a bottom view of the aperture antenna of the first embodiment.

FIG. 3*a* is a top view of the aperture antenna 100, and FIG. 3*b* is a bottom view of the aperture antenna 100. With reference to FIG. 3*a*, the aperture 140 has a feed portion A1, a signal turning point B1, a first edge 141 and a second edge 142. The first edge 141 connects the feed portion A1 to the signal turning point B1 in a first direction (clockwise), and the second edge 142 connects the feed portion A1 to the signal turning point B1 in a second direction (counterclockwise). The first direction is opposite to the second direction. When the aperture antenna 100 transmits the circularly polarized signal, a traveling wave travels on the first edge 141. At least one standing wave stands on the second edge 142. In the embodiment of the invention, the signal turning point is defined as a point between the first edge and the second edge, the traveling wave travels on the first edge, and the standing wave stands on the second edge.

Figure 4:
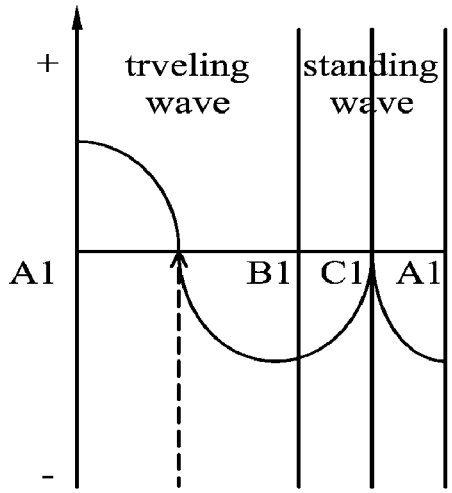
FIG. 4 shows a surface current of the aperture antenna of the first embodiment.

In the first embodiment of the invention, a null point C1 is formed on the second edge 142, and two standing waves are formed on the second edge 142. A first standing wave is formed between the feed portion A1 and the null point C1, and a second standing wave is formed between null point C1 and the signal turning point B1. FIG. 4 shows a surface current of the aperture antenna 100.

Figure 5:
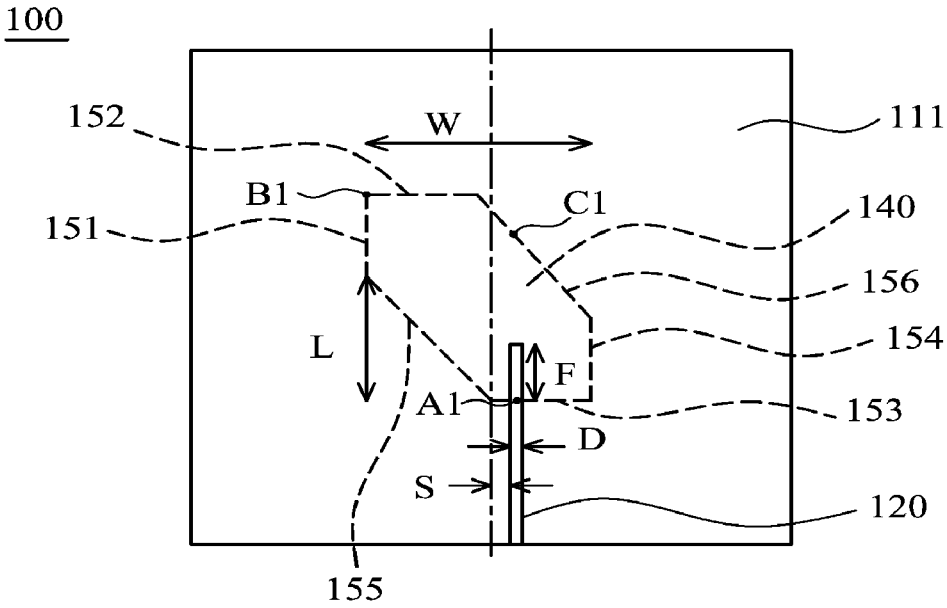
FIG. 5 shows a detailed structure of the aperture antenna of the first embodiment.

With reference to FIG. 5, the aperture antenna 140 is hexagon, comprising a first side 151, a second side 152, a third side 153, a fourth side 154, a fifth side 155 and a sixth side 156. The first side 151 is connected to the second side 152, the first side 151 is perpendicular to the second side 152, the third side 153 is connected to the fourth side 154, the third side 153 is perpendicular to the fourth side 154, the fifth side 155 connects the first side 151 to the third side 153, the sixth side 156 connects the second side 152 to the fourth side 154, and the fifth side 155 is parallel to the sixth side 156. A length of the first side 151 is equal to a length of the second side 152. A length of the fifth side 155 is equal to a length of the sixth side 156. The length of the first side 151 is equal to the length of the third side 153, and the length of the third side 153 is equal to the length of the fourth side 154. The signal turning point B1 is located on a connection point of the first side 151 and the second side 152, and the feed portion A1 is located on the third side 513. The feed conductor 120 is perpendicular to the third side 153, and correspondingly passing the feed portion A1. The null point C1 is located on the sixth side 156. The first edge extends from the feed portion A1, passing the third side 153, the fifth side 155 and the first side 151 to the signal turning point B1. The second edge extends from the feed portion A1, passing the third side 153, the fourth side 154, the sixth side 156 and the second side 152 to the signal turning point B1.

In a modified embodiment, the length of the first side 151 is equal to the length of the third side 153, the length of the second side 152 is equal to the fourth side 154, and the length of the third side 153 is not equal to the fourth side 154.

In the first embodiment, the aperture has an aperture side length W=24 mm, a feed length F=8.9 mm, a beveled length L=13 mm, and a feed conductor width D=0.6 mm. The feed conductor is held a distance S=3.9 away from a point where the third side 153 connects the fifth side 155. In the first embodiment, an operation frequency of the aperture antenna can be modified by changing the aperture side length. The return loss matching of the aperture antenna can be modified by changing the feed length of the feed conductor. The frequency of the return loss matching and the axial ratio can be modified by changing the position of the feed conductor. In the first embodiment, the hexagon aperture is formed by cutting of the opposite corners of a square to transmit circularly polarized signal.

Figure 6:
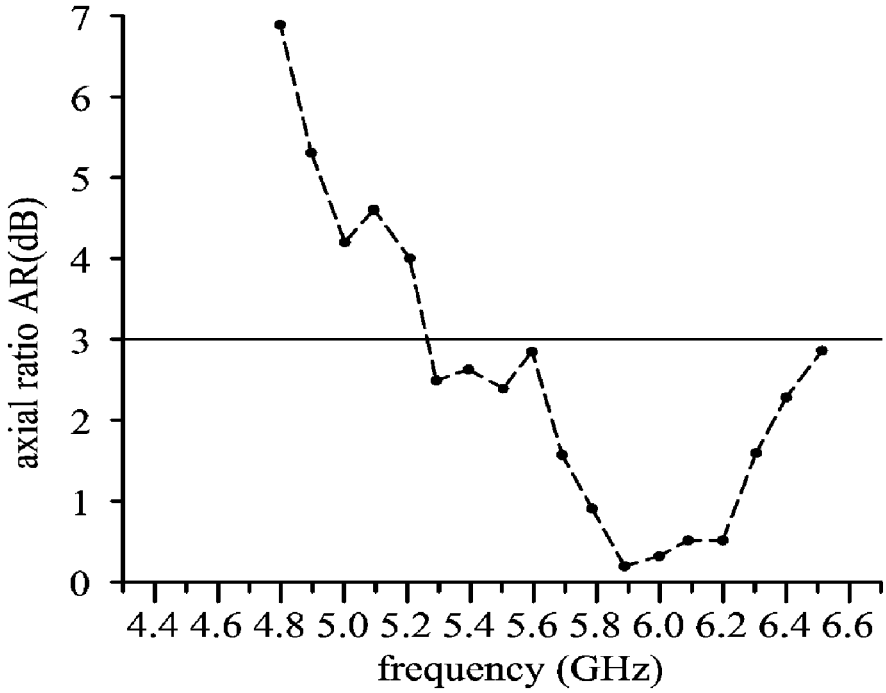
FIG. 6 shows the transmission of the aperture antenna of the first embodiment.

FIG. 6 shows the transmission of the aperture antenna of the first embodiment, wherein the aperture antenna of the first embodiment provides an axial ratio bandwidth of about 18~20%, which can transmit a wideband circularly polarized signal.

Figure 7:
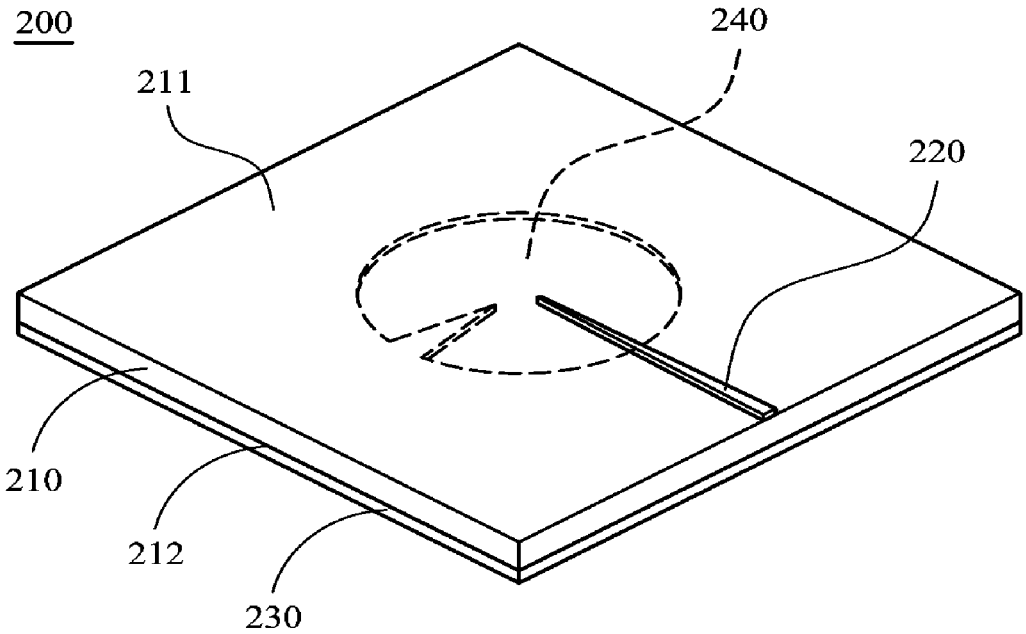
FIG. 7 shows an aperture antenna of a second embodiment of the invention.

FIG. 7 shows an aperture antenna 200 of a second embodiment of the invention for transmitting a circularly polarized signal. The aperture antenna 200 comprises an antenna substrate 210, a feed conductor 220 and an antenna ground layer 230. The antenna substrate 210 comprises a first surface 211 and a second surface 212. The feed conductor 220 is disposed on the first surface 211. The antenna ground layer 230 is disposed on the second surface 212. The antenna ground layer 230 has an aperture 240.

Figure 8:
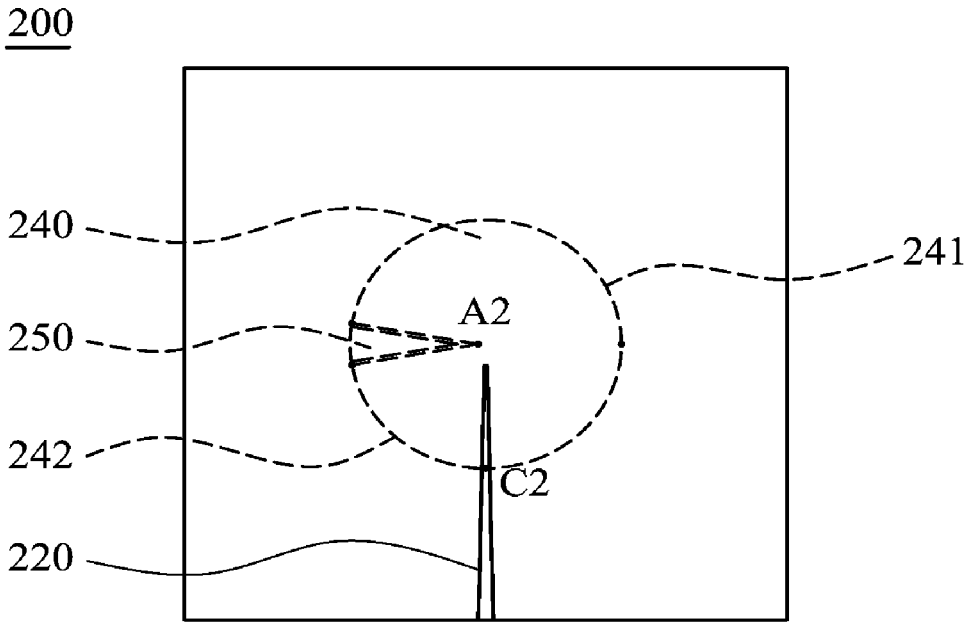
FIG. 8 is a top view of the aperture antenna of the second embodiment.

FIG. 8 is a top view of the aperture antenna 200. With reference to FIG. 8, the aperture 240 has a feed portion C2, a signal turning point A2, a first edge 241 and a second edge 242. The first edge 241 connects the feed portion C2 to the signal turning point A2 in a first direction (counterclockwise), and the second edge 242 connects the feed portion C2 to the signal turning point A2 in a second direction (clockwise). The first direction is opposite to the second direction. When the aperture antenna 200 transmits the circularly polarized signal, a traveling wave travels on the first edge 241. A standing wave stands on the second edge 242. The circularly polarized radiation property of the aperture antenna 200 can be modified by changing the length of the first edge 241. The return loss matching of the aperture antenna 200 can be modified by changing the length of the second edge 242.

In the second embodiment, the aperture 240 is circular, and has a sector notch 250 formed on a circumference of the aperture 240. The signal turning point A2 is located on the tip of the sector notch 250.

Figure 9:
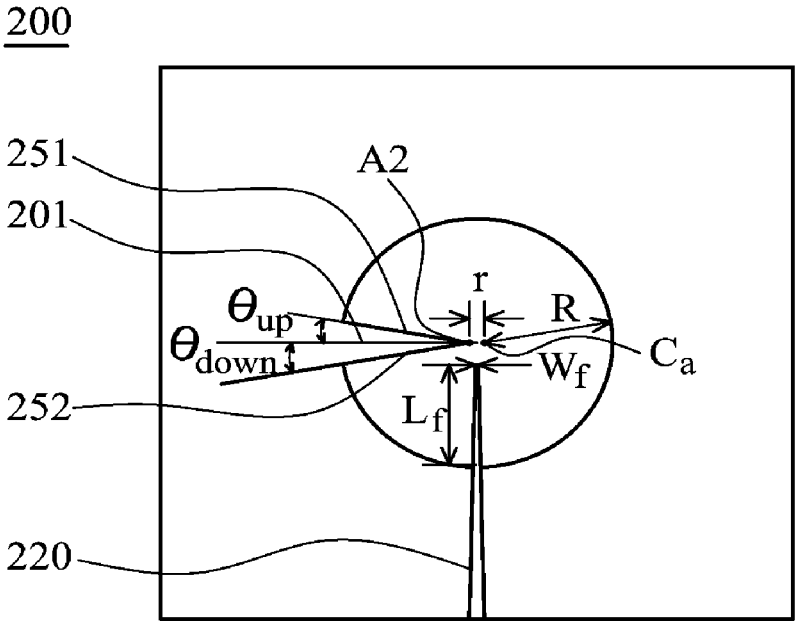
FIG. 9 shows a detailed structure of the aperture antenna of the second embodiment.

With reference to FIG. 9, the aperture antenna 200 further comprises a base line 201, the base line passes the signal turning point A2 and a center $C_a$ of the aperture, the sector notch has a first side 251 and a second side 252, the first side 251 is located on the first edge 241, the second side 252 is located on the second edge 242, a first included angle $\theta_{up}$ is formed between the first side 251 and the base line 201, and a second included angle $\theta_{down}$ is formed between the second side 252 and the base line 201. The first included angle $\theta_{up}$ can be changed to modify a return loss matching of the aperture antenna. The second included angle $\theta_{down}$ can be changed to modify a frequency of the circularly polarized signal and a purity thereof. The return loss matching and axial ratio bandwidth can be modified by changing a distance r between the signal turning point A2 and the center $C_a$ of the aperture.

In one embodiment, the feed conductor 220 extends toward the center $C_a$ of the aperture 240, and the length of the first edge 242 is equal to a quarter of a circumference length of the aperture 240. The circumference length of the aperture is about $3\lambda_o$, wherein $\lambda_o$ is a vacuum wave length of a central frequency of the circularly polarized signal. The diameter of the aperture is about $\lambda_g$, wherein $\lambda_g$ is a guide wave length of the circularly polarized signal.

In one embodiment, the first included angle $\theta_{up}$ is 10°, and the second included angle $\theta_{down}$ is 10°. The width $W_f$ of the feed conductor is 0.3 mm. The feed length $L_f$ of the feed conductor is 11 mm. The distance between the signal turning point A2 and the center $C_a$ of the aperture is 3 mm, and a radius R of the aperture is 14 mm.

Figure 10:
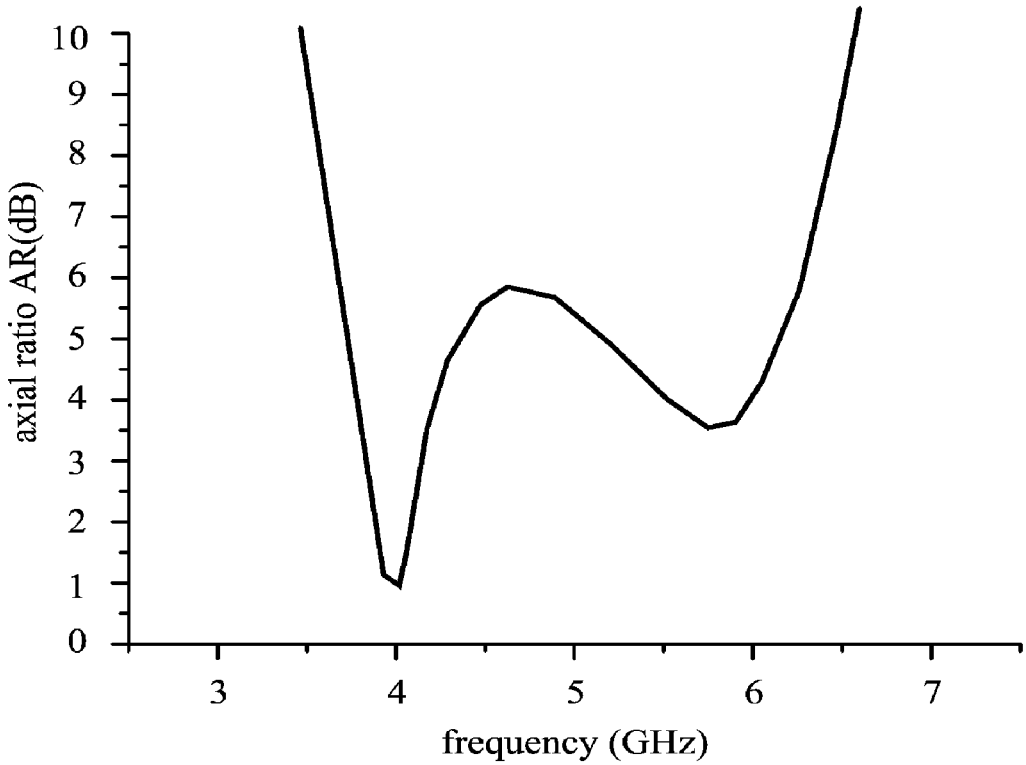
FIG. 10 shows the transmission of the aperture antenna of the second embodiment.

FIG. 10 shows the transmission of the aperture antenna of the second embodiment, wherein the aperture antenna of the first embodiment provides an axial ratio bandwidth of about 7.6%, which is better than transmission of prior art.

In the embodiments of the invention the circularly polarized signal travels in a right or left spin path. However, the invention is not limited thereto.

The transmission data disclosed in the embodiments is data gathered under a single radiation condition. The aperture antennas of the embodiments can be utilized with a reflector, a cavity back element or an electromagnetic band gap element to provide a single radiation property. The reflector and cavity back technologies are mature technologies, and thus related description is omitted.

Figure 11:
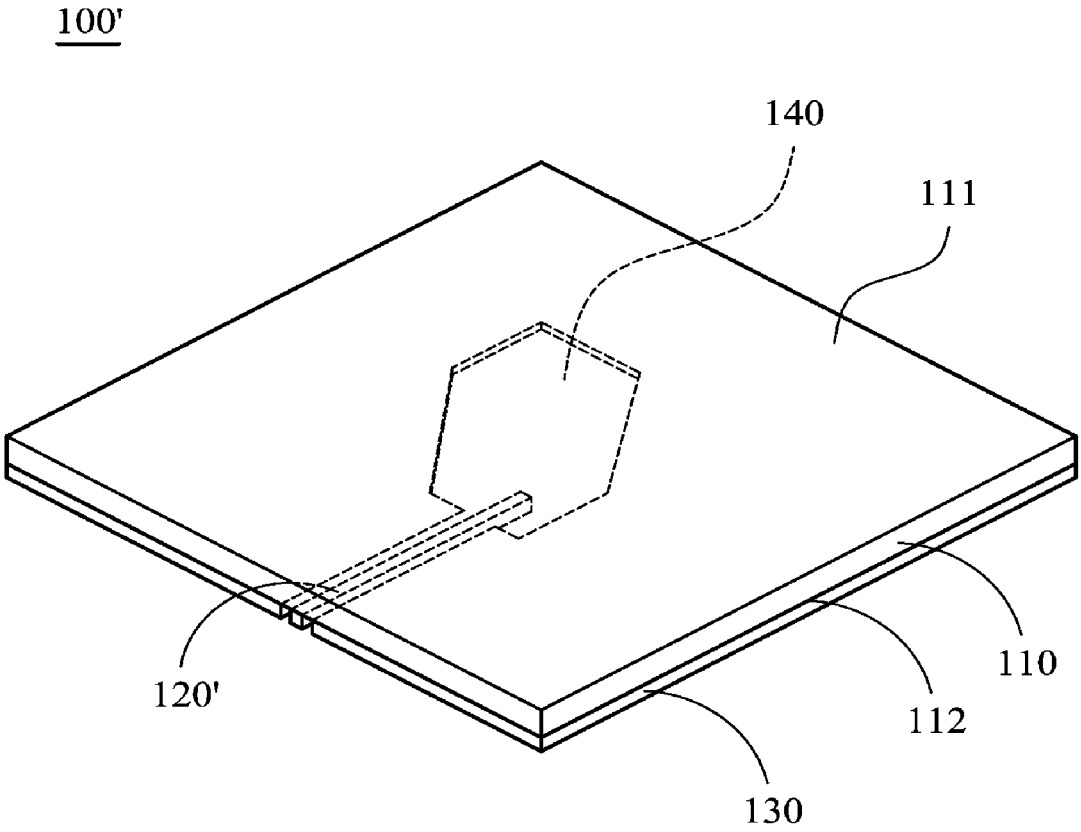
FIG. 11 shows an aperture antenna of a third embodiment of the invention.

FIG. 11 shows an aperture antenna 100' of the third embodiment of the invention, wherein a feed conductor 120' is disposed on the second surface 112 as a coplanar-waveguide-fed, and passing the feed portion.

While the invention has been described by way of example and in terms of the preferred embodiments, it is to be understood that the invention is not limited to the disclosed embodiments. To the contrary, it is intended to cover various modifications and similar arrangements (as would be apparent to those skilled in the art). Therefore, the scope of the appended claims should be accorded the broadest interpretation so as to encompass all such modifications and similar arrangements.

What is claimed is:

1. An aperture antenna for transmitting a circularly polarized signal, comprising:

an antenna substrate, having a first surface and a second surface;

an antenna ground layer, disposed on the second surface, wherein the antenna ground layer has an aperture, the aperture has a feed portion, a signal turning point, a first edge and a second edge, the first edge connects the feed portion to the signal turning point in a first direction, and the second edge connects the feed portion to the signal turning point in a second direction, the first direction is opposite to the second direction, and when the aperture antenna transmits the circularly polarized signal, a traveling wave travels on the first edge, and at least one standing wave is formed on the second edge; and a feed conductor, passing the feed portion and corresponding to aperture, wherein the aperture is circular, the aperture has a sector notch formed on a circumference thereof, and the signal turning point is located on a tip of the sector notch.

2. The aperture antenna as claimed in claim 1, further comprising a base line, the base line passes the signal turning point and a center of the aperture, the sector notch has a first side and a second side, the first side is located on the first edge, the second side is on the second edge, a first included angle is formed between the first side and the base line, and a second included angle is formed between the second side and the base line.

3. The aperture antenna as claimed in claim 2, wherein the first included angle can be changed to modify a return loss matching of the aperture antenna.

4. The aperture antenna as claimed in claim 2, wherein the second included angle can be changed to modify a frequency of the circularly polarized signal and a purity thereof.

5. The aperture antenna as claimed in claim 2, wherein the feed conductor extends in a direction perpendicular to the base line.

6. The aperture antenna as claimed in claim 1, wherein the first edge is longer than the second edge.

7. The aperture antenna as claimed in claim 1, wherein a length of the second edge is about equal to a quarter of a circumference length of the aperture.

8. The aperture antenna as claimed in claim 1, wherein a circumference length of the aperture is about $3\lambda_o$, and $\lambda_o$ is a vacuum wave length of a central frequency of the circularly polarized signal.

9. The aperture antenna as claimed in claim 1, wherein a diameter of the aperture is about $\lambda_g$, and $\lambda_g$ is a guide wave length of the circularly polarized signal.

10. The aperture antenna as claimed in claim 1, wherein feed conductor is a microstrip-fed formed on the first surface.

11. The aperture antenna as claimed in claim 1, wherein feed conductor is a coplanar-wave-guide-fed formed on the second surface.

* * * * *